US005819364A

United States Patent [19]

Sham

[11] Patent Number: 5,819,364

[45] Date of Patent: Oct. 13, 1998

[54] DETACHABLE HANDLE ACCESSORY FOR A PORTABLE STEAM VACUUM CLEANER

[75] Inventor: John C. K. Sham, Hong Kong, Hong Kong

[73] Assignee: Pentalpha Enterprises, Ltd., Aberdeen, Hong Kong

[21] Appl. No.: 526,878

[22] Filed: Sep. 12, 1995

Related U.S. Application Data

[63] Continuation-in-part of Ser. No. 323,242, Oct. 14, 1994, abandoned, which is a continuation of Ser. No. 101,852, Aug. 14, 1993, abandoned, which is a division of Ser. No. 942,308, Sep. 9, 1992, Pat. No. 5,341,541.

[51] Int. Cl.[6] ..... A47L 9/32

[52] U.S. Cl. ..... 15/320; 15/329; 15/344; 15/410

[58] Field of Search ..... 15/320, 344, 410, 15/329

[56] References Cited

U.S. PATENT DOCUMENTS

| | | | |
|---|---|---|---|
| D. 307,657 | 5/1990 | Li | 15/329 X |
| 1,728,021 | 9/1929 | Tuteur | 15/329 |
| 2,230,077 | 1/1941 | Foss | 15/329 |
| 2,303,409 | 12/1942 | Taylor | 15/329 |
| 2,598,499 | 5/1952 | Breuer et al. | 15/410 X |
| 4,467,493 | 8/1984 | Buchtel . | |
| 4,545,089 | 10/1985 | Oxel . | |
| 4,583,260 | 4/1986 | Zai | 15/328 |
| 4,635,318 | 1/1987 | Kozak | 15/410 X |
| 4,665,582 | 5/1987 | Richmond et al. | 15/351 X |
| 4,683,607 | 8/1987 | Lackner et al. . | |
| 4,686,735 | 8/1987 | Soeffker et al. . | |
| 4,766,638 | 8/1988 | McDowell | 15/410 X |
| 4,845,802 | 7/1989 | Miller et al. . | |
| 5,224,237 | 7/1993 | Ambrosiano . | |
| 5,309,600 | 5/1994 | Weaver et al. . | |
| 5,311,638 | 5/1994 | Furcron et al. . | |
| 5,367,740 | 11/1994 | McCray | 15/320 |
| 5,507,068 | 4/1996 | Fan et al. | 15/320 |

*Primary Examiner*—Chris K. Moore
*Attorney, Agent, or Firm*—Salzman & Levy

[57] ABSTRACT

A detachable handle accessory is provided which permits a user to operate a portable, hand-held steam vacuum cleaner as an upright steam vacuum cleaner. The detachable handle accessory includes a support base, a handle portion extending upwardly from the support base and a wheel assembly affixed to the support base. The support base includes mounting structure which allows a nozzle of a hand-held steam vacuum cleaner to be located intermediate the support base and surface to be cleaned so as to permit an unobstructed flow of steam from the portable vacuum cleaner to the surface. The handle portion is used to control and steer the nozzle over the surface while the wheel assembly allows a user to roll the support base and steam vacuum cleaner over the surface from an upright position, and to engage a squeegee member at the distal end of the nozzle with the surface to be cleaned to facilitate gathering of liquid and enhance the suctioning process of the vacuum cleaner.

16 Claims, 5 Drawing Sheets

36
34
48
40
50
46
12
52
16
38
54
58
30
44
58
32
56
28
60
47
45
40
22
26
10
14
26
26
18
20
26
24
18

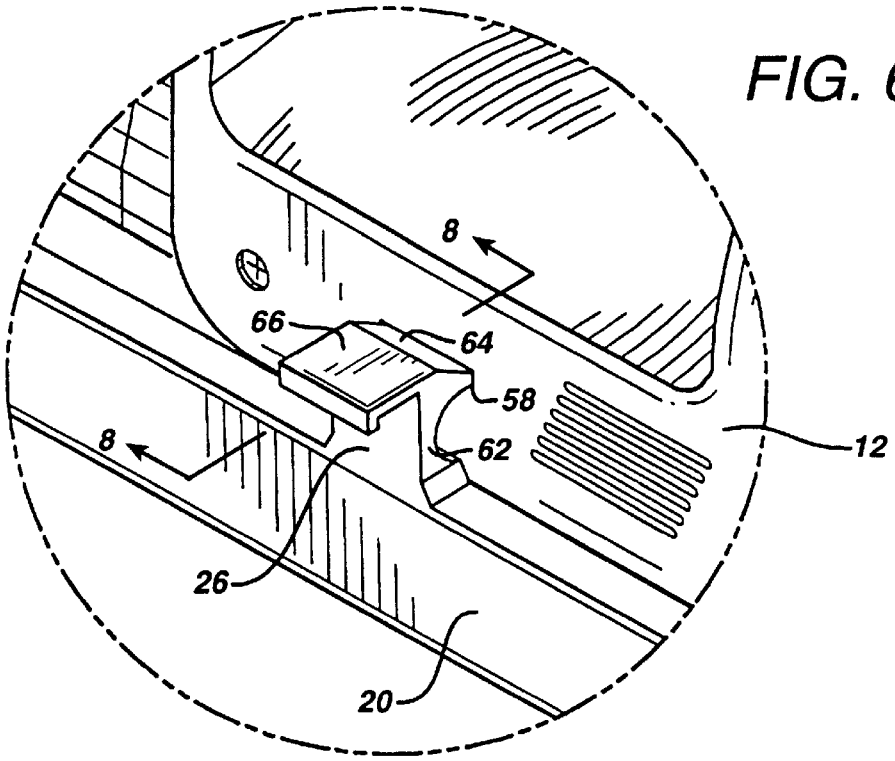
FIG. 6
FIG. 7
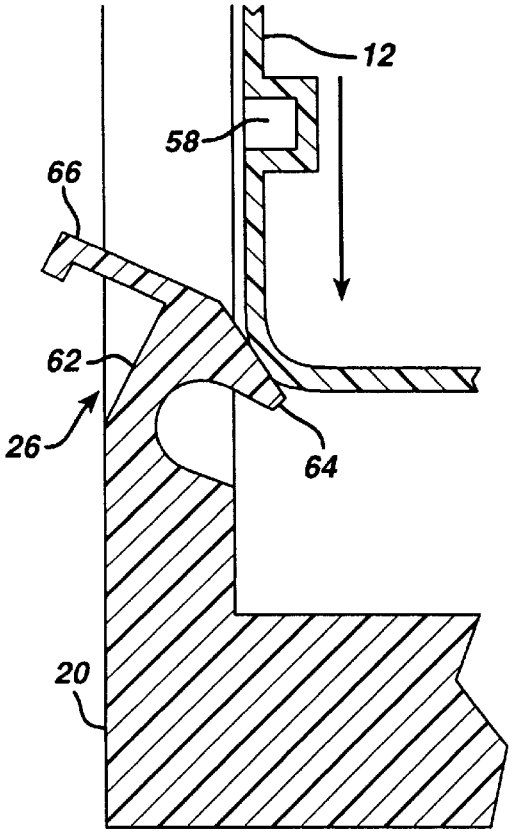
FIG. 8
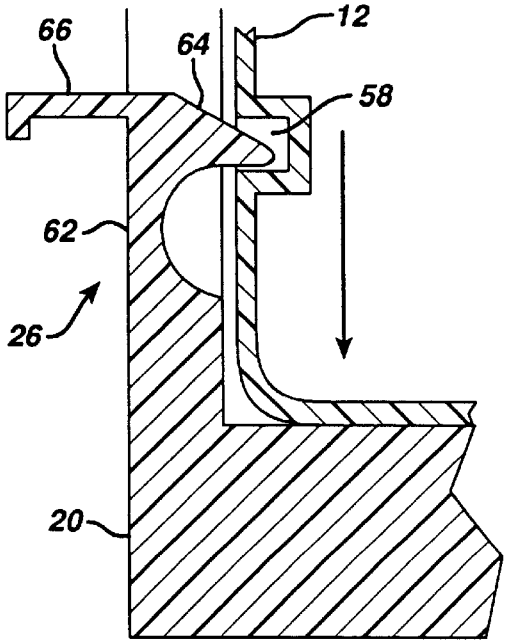

DETACHABLE HANDLE ACCESSORY FOR A PORTABLE STEAM VACUUM CLEANER

CROSS-REFERENCE TO RELATED APPLICATIONS

This application is a continuation-in-part of U.S. application Ser. No. 08/323,242, filed Oct. 14, 1994, now abandoned which is a continuation of U.S. application Ser. No. 08/101,852, filed Aug. 4, 1993, now abandoned, which is a divisional of U.S. application Ser. No. 07/942,308, filed Sep. 9, 1992, now U.S. Pat. No. 5,341,541.

BACKGROUND OF THE INVENTION

1. Field of the Invention

This application relates generally to portable, hand-held steam vacuum cleaners and methods of cleaning and, more particularly, to a detachable handle accessory for use with a hand-held steam vacuum cleaner to convert the is hand-held vacuum cleaner into an upright vacuum cleaner.

2. Description of Related Art

Various portable hand-held vacuum cleaners are known which allow a user to vacuum up dirt and debris. These units generally create a flow of material in one direction, i.e., from the surface to be cleaned into the portable vacuum cleaner. However, other types of vacuum cleaners, such as, for example, steam vacuum cleaners, generate flows of material in two directions, i.e., steam out of the vacuum cleaner to the surface to be cleaned and then liquid and debris from the surface back into the vacuum cleaner. It will be noted that while spraying steam from the vacuum cleaner to the surface, the steam nozzle of the vacuum cleaner must be unobstructed; that is, it must have direct access to the surface to be steamed for best efficiency. Steam vacuum cleaners also must maintain contact with the surface being cleaned during the suction mode, and typically provide a flexible scraper or "squeegee", generally of rubber, at the suction nozzle to facilitate the suctioning and to gather the liquid towards the nozzle.

Hand-held steam vacuum cleaners permit the user to manipulate the nozzle portion to both direct the steam and to facilitate the suctioning process by utilizing the rubber squeegee at the nozzle end. While accessories have been provided in the prior art to convert the hand-held vacuum cleaners, without the steam feature, into an upright vacuum, none have addressed the problems associated with steam hand-held vacuum cleaners, since steam hand-held vacuum cleaners are a recent innovation. These problems include, among others, positioning the steam outlet in close proximity to the surface to be cleaned, and maintaining the squeegee portion in good contact with surface while permitting the user to manipulate the nozzle for efficient suctioning.

A portable hand-held steam vacuum cleaner is described in commonly assigned U.S. Pat. No. 5,341,541, the entire disclosure of which is incorporated by reference herein. U.S. Pat. No. 5,341,541 describes a portable hand-held steam vacuum cleaner which includes a housing having a handle grip portion and a nozzle portion. A reservoir is located on the housing for retaining cleaning solution or water, and a heating unit is associated with the reservoir within the housing for heating the liquid so as to generate steam for delivery to a surface to be cleaned. A motor driven fan assembly is disposed within the housing in communication with the nozzle portion for drawing excess liquid and debris into the nozzle portion. The nozzle portion defines structure for separating and containing the liquid which is drawn into the vacuum cleaner, and includes a rubber squeegee attachment for gathering the liquid.

While the cleaner described in above-incorporated U.S. Pat. No. 5,341,541 is versatile and effective for cleaning carpets and floors, like all hand-held vacuum cleaners it requires the user to oftentimes bend or kneel to vacuum surface areas. This tends to be both inconvenient and uncomfortable and may tire the user after a prolonged period of use.

Accordingly, there is a need for a detachable handle accessory for use with a portable hand-held steam vacuum cleaner to permit the user to operate the steam vacuum cleaner as a hand-held unit or as an upright steam vacuum cleaner without reducing the efficiency of the liquid suctioning capability of the steam vacuum cleaner when used with the handle accessory.

SUMMARY OF THE INVENTION

It is an object of this invention to provide a detachable handle accessory for use with a portable hand-held steam vacuum cleaner in order to efficiently and comfortably clean surfaces from an upright position.

A detachable handle accessory for supporting and manipulating a portable hand-held steam vacuum cleaner over a surface to convert the hand-held cleaner to an upright cleaner is provided. The detachable handle accessory includes a support base, an upwardly extending handle including a hand grip portion and having an extension tube which is detachably affixed to the support base for storage, and a wheel assembly connected to the support base. The hand-held portable steam vacuum cleaner is detachably mounted to the support base and fastened thereto such that a nozzle portion of the hand-held steam vacuum cleaner rests unobstructed over the surface to be cleaned, and the rubber scraper or squeegee associated with the nozzle, which facilitates gathering of the liquid on the surface for pick-up during suctioning, also is optimally positioned to maintain contact with the surface. Preferably, a bracket is formed on the support base to position the nozzle portion with respect to the surface to be cleaned.

During the operation of the vacuum cleaner, from an upright position the user grasps the hand-piece to control and steer the nozzle portion over a surface for projecting steam and drawing up debris. The wheel assembly allows the user to conveniently roll and steer the vacuum cleaner over the surface. The construction of the handle accessory is such that the vacuum cleaner carrier portion is at a predetermined angle to the surface with respect to the handle to maximize the collection feature of the nozzle during the suctioning mode of operation. With the present invention a user can effectively and comfortably clean a surface using the hand-held steam vacuum cleaner from an upright position.

Further features of the invention and its various advantages will become more apparent to one skilled in the art from the following detailed description of the invention taken in conjunction with the accompanying drawings.

BRIEF DESCRIPTION OF THE DRAWINGS

A preferred embodiment of the subject invention is described hereinbelow with reference to the accompanying drawings, wherein:

FIG. 6 is an enlarged perspective view of one embodiment of a snap lock for securing a hand-held steam vacuum cleaner to the detachable handle accessory;

FIG. 7 is a side elevational view, shown in section, of the snap lock assembly as the vacuum is assembled onto the handle accessory; and FIG. 8 is a side view, shown in section, taken along line 8—8 of FIG. 6.

DETAILED DESCRIPTION OF PREFERRED EMBODIMENTS

Figure 1:
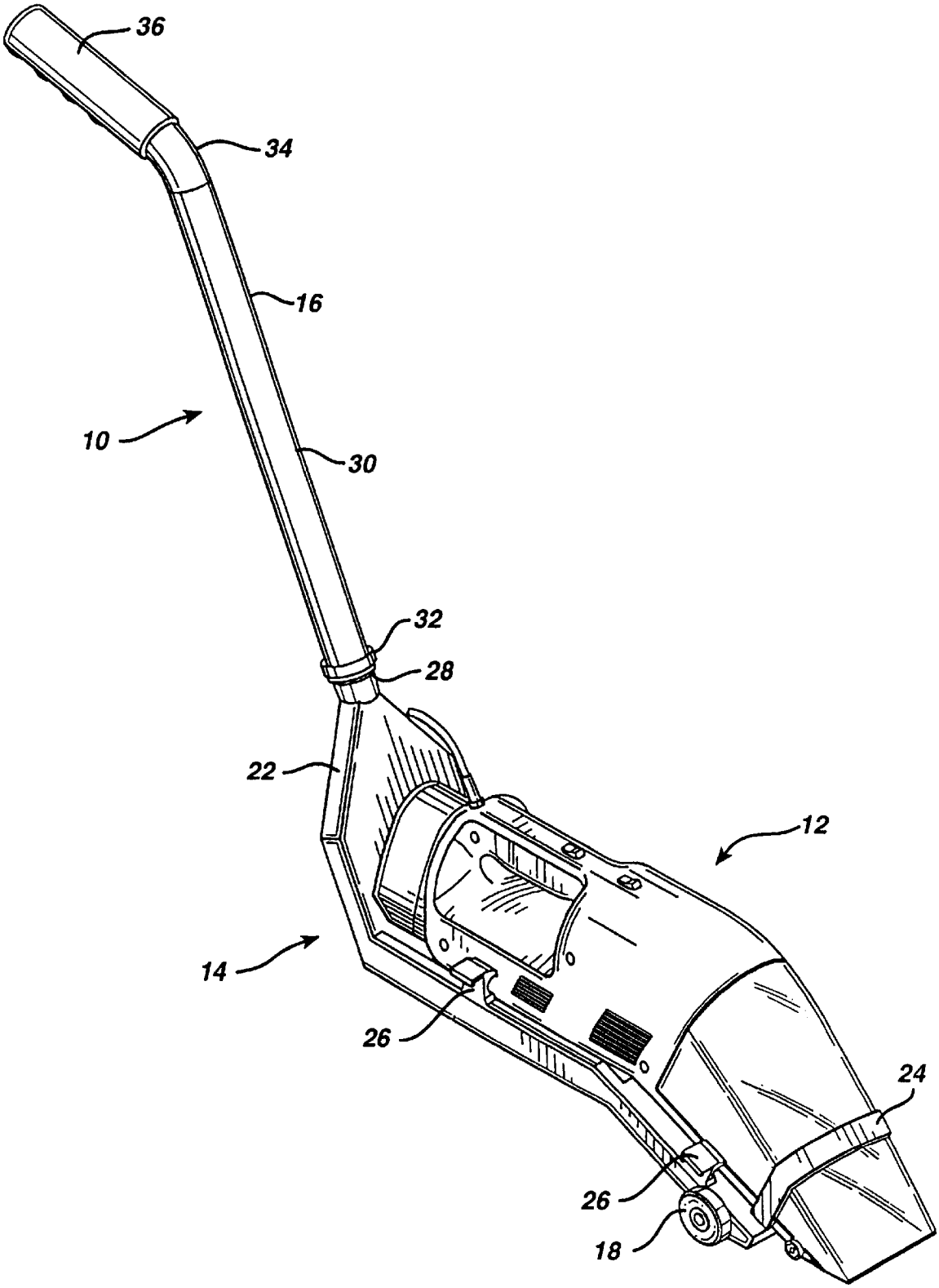
FIG. 1 is a perspective view of a preferred embodiment of a detachable handle accessory with a hand-held steam vacuum cleaner mounted thereon.

Referring now the drawings in which like reference numerals identify similar or identical elements throughout the several views, and referring initially to FIG. 1, there is illustrated a detachable handle accessory 10 which is particularly suited for use with a portable hand-held steam vacuum cleaner 12 of the type described in U.S. Pat. No. 5,341,541. Detachable handle accessory 10 generally includes a support base 14 having a handle 16 extended upwardly therefrom. Wheels 18 are provided at a distal end of support base 14 for rolling the accessory over a surface.

Figure 2:
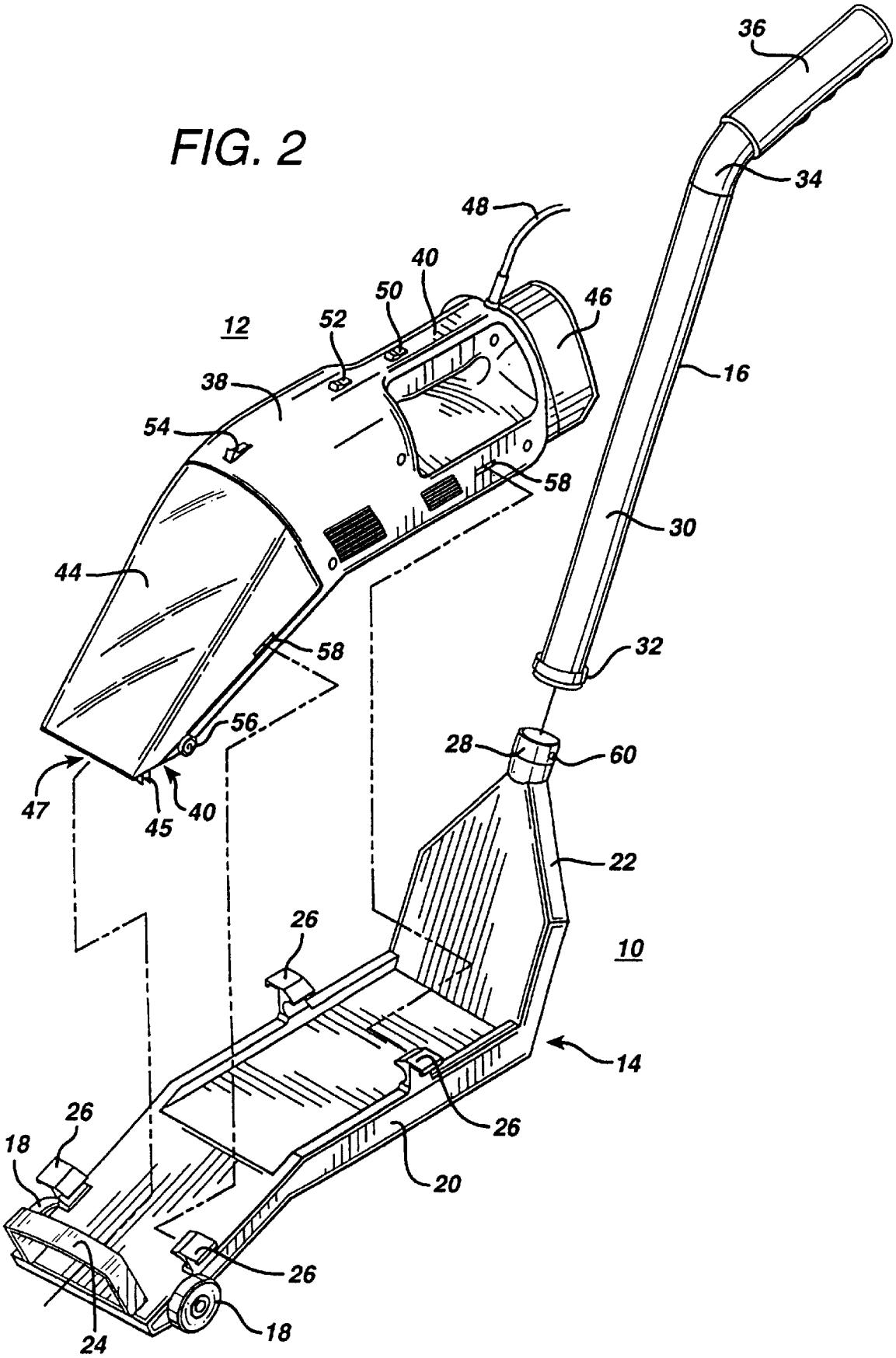
FIG. 2 is a perspective view of the detachable handle accessory and hand-held steam vacuum cleaner with parts separated.

Referring now to FIGS. 1 and 2, support base 14 generally includes a sled section 20 which is configured to conform to the general shape of hand-held steam cleaner 12, and an upright section 22. Upright section 22 forms an angle of approximately 135° with sled section 20, which maintains the distal end of nozzle portion 44 at the proper angle for optimal steaming and to facilitate the suctioning of liquid by engaging squeegee member 45 with the surface. The squeegee member 45 gathers liquid and serves to enhance suctioning, particularly on surfaces such as fabrics, including rugs and upholstery.

A U-bracket 24 is provided at the distal end of sled section 20 for receipt of the nozzle portion 44 of steam cleaner 12. To releasably secure steam cleaner 12 to sled section 20, side snap lock assemblies 26 are provided to engage corresponding structure on steam cleaner 12 thereby releasably securing steam cleaner 12 to sled section 20. Snap lock assemblies 26 are shown for example only, and any locking mechanism may be provided to secure steam cleaner 12 to sled section 20. Upright section 22 may additionally be provided with an additional lock mechanism formed thereon and configured to engage a proximal end of portable steam cleaner 12. Preferably, handle 16 is detachable from support base 14 to facilitate storage when the accessory is not in use. Thus, upright section 22 includes a fitting collar 28 which engages a portion of handle 16 as described below.

Handle 16 includes an extension tube 30 which may be of the telescopic variety or single length configured to suit the particular user. Extension tube 30 includes a connector 32 at a distal end which is configured to releasably engage fitting collar 28 on upright section 22. At a proximal-most end of handle of extension tube 30 there is provided a hand piece 34 which is angled at approximately 30° to the horizontal to provide ergonomic advantage for the operator, while functioning in conjunction with the angle of sled section described above to maintain contact between squeegee member 45 and the surface during suctioning, and to position the steam ports for optimal steaming. Hand piece 34 may be provided with a finger grip or friction increasing cover 36 to prevent the handle from slipping out of the hand of the user.

Figures 4, 5:
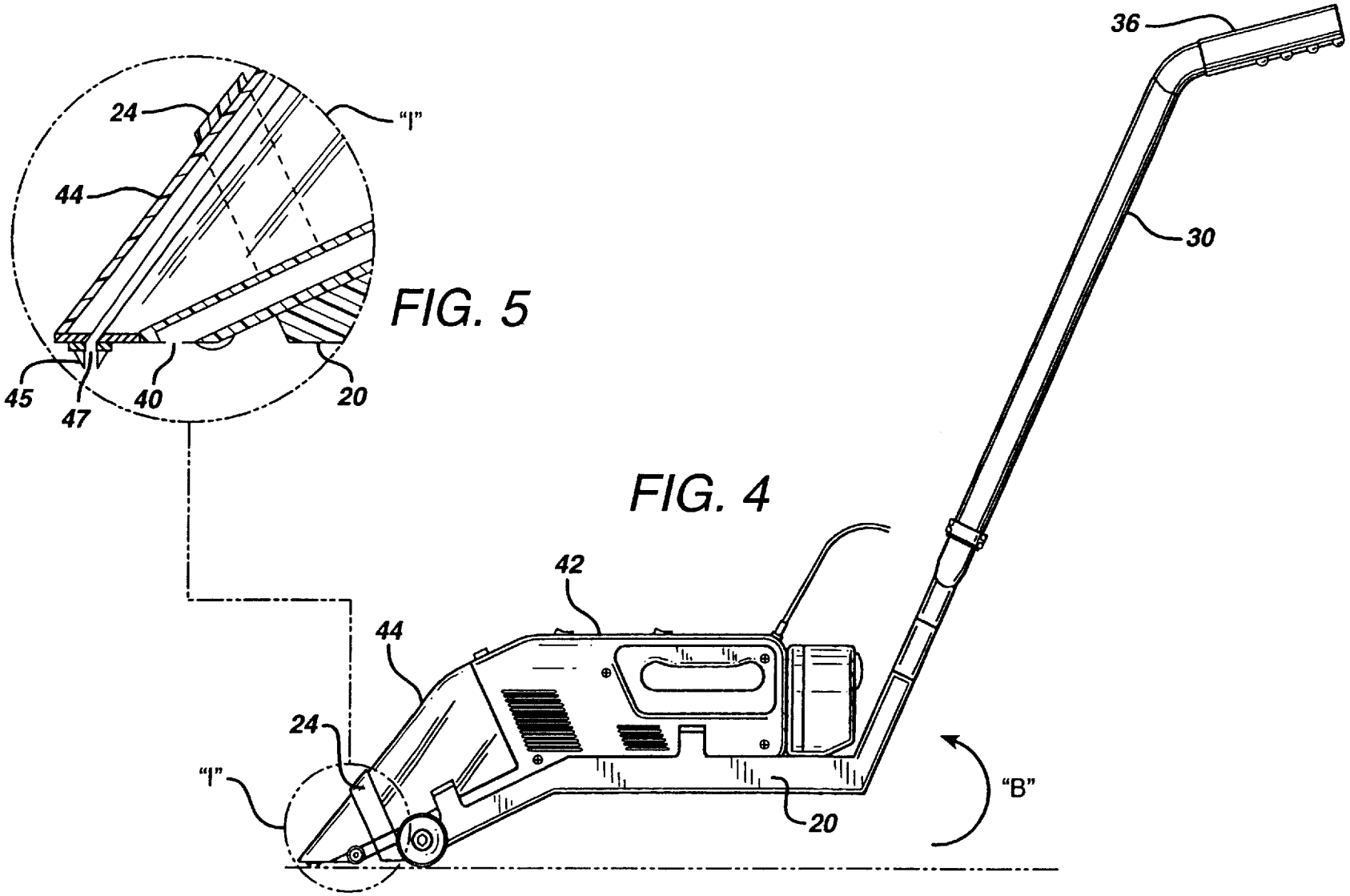
FIG. 4 is a side elevational view of the detachable handle accessory with the hand-held steam vacuum cleaner mounted thereon.
FIG. 5 is an enlarged partial view in cross-section of the distal end of the detachable handle accessory and hand-held steam vacuum cleaner of the detail "I" of FIG. 4.

Referring now to FIG. 2, and as noted hereinabove, steam cleaner 12 is of the type disclosed in U.S. Pat. No. 5,341,541 and generally includes a housing 38 having a nozzle 44 having a suction port 47, a squeegee member 45, and a steam discharge port 40 in an underside of the housing, and a handle 42 associated with the housing 38. Squeegee member 45 is preferably mounted on nozzle 44 such that it surrounds suction port 47 (FIG. 5). Preferably, nozzle 44 is detachable from housing 38 and may be internally bifurcated to provide for both the collection of liquid and debris. Steam cleaner 12 also includes a reservoir 46 for holding fluid to be turned into steam. Steam cleaner 12 includes an elongated power cord 48 and an on-off type toggle switch 50 for operating the device. Additionally, a control valve 52 is provided to control an internal heater and pump to discharge liquid into an internal steam chamber. As disclosed in U.S. Pat. No. 5,341,541, the internal steam chamber includes a heating element to convert the liquid to steam which is then discharged to the surface to be cleaned.

Preferably, a nozzle latch 54 is provided to detach nozzle 44 for cleaning and servicing. Steam cleaner 12 may additionally include miniature wheels 56 at a distal end thereof to facilitate the use of steam cleaner 12 on various solid surfaces such as, for example, tables, ledges, floors, counter tops, rugs, furniture, etc.

As noted hereinabove, by way of example only, steam cleaner 12 includes structure for engagement with side snap lock assemblies 26. As shown in FIG. 2, steam cleaner 12 is provided with slots 58 which engage side snap lock assemblies 26 to releasably secure steam cleaner 12 on detachable handle accessory 10.

As noted hereinabove, handle 16 is releasably secured to support base 14 in order to allow detachable handle accessory 10 to be collapsed for storage. The connection between fitting collar 28 on upright section 22 and connector 32 on extension 30 may be of the notch and detent variety and include a detent button 60 formed on fitting collar 28 which engages a corresponding detent within connector 32.

In using detachable handle accessory 10 with steam cleaner 12, detachable handle accessory 10 is initially assembled by attaching handle 16 to support base 14. As disclosed above, collar 28 on sled section 20 releasably engages connector 32 on extension tube 30 to thereby connect handle 16 with support base 14. Once support base 14 and handle 16 have been assembled, steam cleaner 12 is affixed thereto by initially positioning nozzle 44 within U-bracket 24 and sliding nozzle 44 until it completely abuts U-bracket 24. Once nozzle 44 has been inserted within bracket 24, steam cleaner 12 is pressed downwardly thereby causing side snap lock assemblies 26 to engage slots 58 in housing 38.

Figure 3:
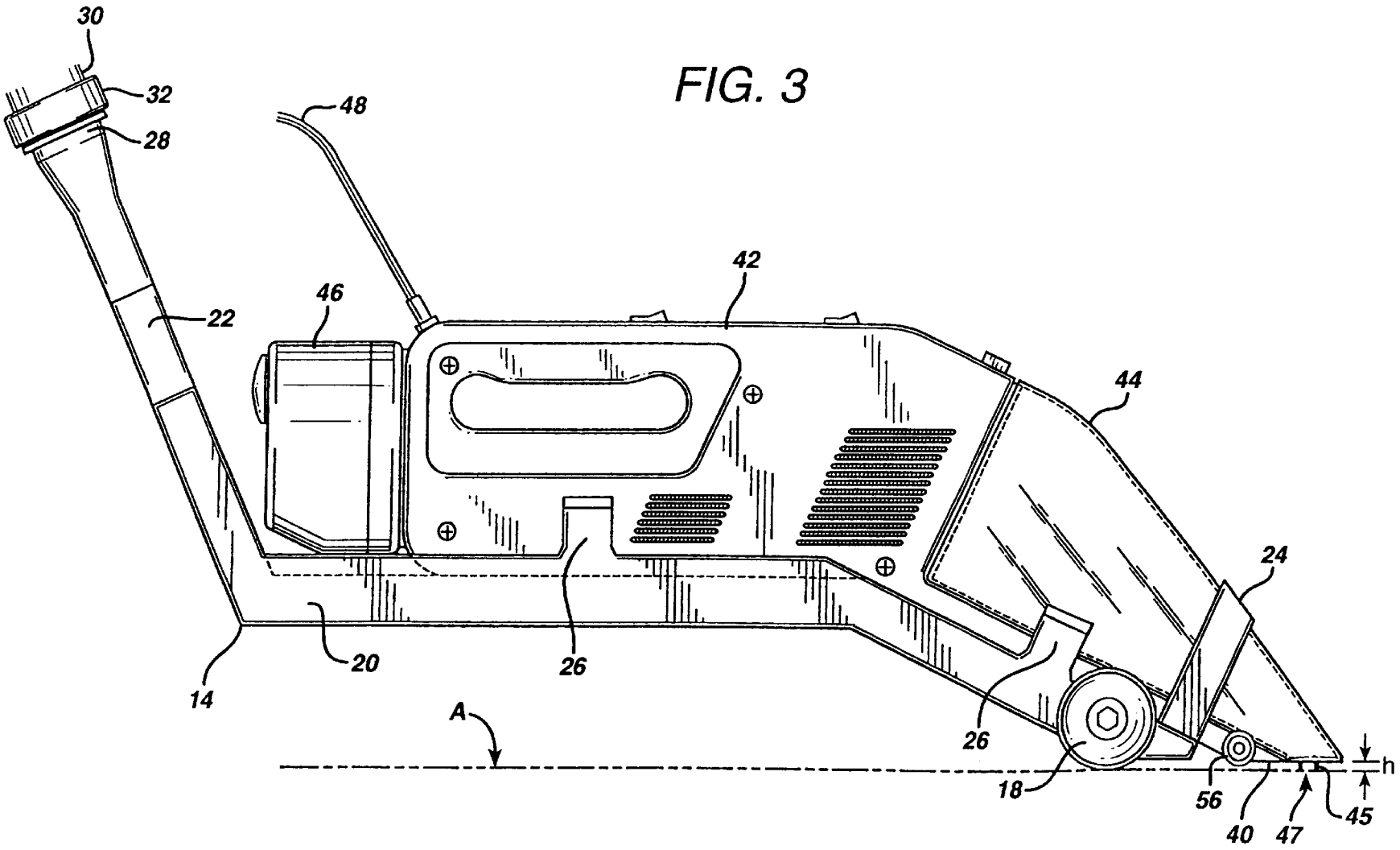
FIG. 3 is a partial side elevational view of the detachable handle accessory with a hand-held steam vacuum cleaner mounted thereon.

Referring now to FIGS. 3–5, it can be seen that once portable steam cleaner 12 has been attached to detachable handle accessory 10, nozzle 44 projects beyond an end of sled section 20. As shown in FIG. 3, when support base 14 is in a level position nozzle 44 and thus steam discharge opening 40 are positioned a predetermined height "h" above a surface to be cleaned such as, for example, floor A. In this position, squeegee member 45 is positioned just barely above surface floor A, so that steaming may take place and the steam cleaner/handle assembly may be smoothly slid over floor A through the provision of wheels 18. By raising handle 36, the height "h" of nozzle 44 above floor A is decreased by pivoting sled portion 20 about wheels 18 in the direction of arrow "B" which serves to force squeegee member 45 against the surface A. The angles defined by the sled portion 20, upright section 22, extension tube 30 and handpiece 34 assure that minimum pivoting of sled portion 20 results in maximum contact between squeegee member 45 and floor A, resulting in efficient suctioning of liquid and debris into nozzle 44. The detail of the nozzle 44 in FIG. 5 illustrates the positioning of suction port 47, squeegee member 45, steam discharge openings 40 and sled portion 20.

Referring now to FIGS. 6–8, it can be seen that side snap lock assemblies 26 include a flexible section 62 having a tapered lock portion 64 and a thumb flange 66. Thus, as steam cleaner 12 is pressed downwardly against a side snap lock assembly 26, flexible section 62 flexes until slot 58 aligns with tapered lock portion 64 which then snaps into place in slot 58. To release side snap lock assembly 26 from steam cleaner 12, thumb flange 66 is pressed downwardly allowing flexible section 62 to flex counterclockwise with respect to FIG. 8 thereby drawing tapered lock portion 64 out of slot 58.

It will be understood that various modifications may be made to the embodiments disclosed herein. For example, various length handle sections may be provided as well as varying locking mechanisms. Therefore, the above description should not be construed as limiting, but merely as exemplifications of preferred embodiments. Those skilled in art will envision other modifications within the scope and spirit of the claims appended hereto.

What is claimed is:

1. A handle accessory for use with a portable hand-held vacuum cleaner of the type generating a flow of material out of, and into, a distal end of said hand-held vacuum cleaner, comprising:

a) a support base configured to detachably mount a hand-held vacuum cleaner, such that a distal end of the vacuum cleaner is positioned over a surface to be cleaned, said support base including an upright section and a sled section, said upright section being adjacent said sled section and forming an approximate angle of 135° therewith, and wherein said sled section provides means for detaching said vacuum cleaner;

b) a handle adjacent said upright section, and affixed to said support base, said handle extending upwardly from said support base; and c) a wheel assembly affixed to said support base for moving said vacuum cleaner and handle assembly over said surface to be cleaned.

2. The handle accessory as recited in claim 1, wherein said support base includes an opening at a distal end thereof for receipt of a distal end of the vacuum cleaner.

3. The handle accessory as recited in claim 2, wherein said support base has a bracket at a distal end thereof defining said opening and through which a distal end of the vacuum cleaner protrudes.

4. The handle accessory as recited in claim 1, wherein said support base includes at least one releasable fastener affixed thereto, said at least one releasable fastener releasably engaging the vacuum cleaner.

5. The handle accessory as recited in claim 1, wherein said handle is detachable from said support base.

6. The handle accessory as recited in claim 1, wherein said handle includes a hand grip positioned at an angle approximately 30° from said handle in a direction opposite to said support base.

7. A modular steam vacuum cleaner comprising:

a) a steam vacuum cleaner having:

i) a housing including a nozzle portion;

ii) a reservoir associated with said housing for retaining liquid;

iii) means for heating said liquid to form steam;

iv) means to direct said steam to a surface to be cleaned;

b) a support base for releasable engagement with said housing;

c) a handle extending upwardly from said support base; and d) a wheel assembly affixed to said support base to move said modular steam vacuum cleaner over said surface to be cleaned.

8. The modular steam vacuum cleaner as recited in claim 7, wherein said handle is detachably mounted to said support base.

9. The modular steam vacuum cleaner as recited in claim 7, wherein said support base includes at least one releasable fastener configured to releasably engage said housing.

10. A handle accessory for use with a portable hand-held vacuum cleaner of the type having a nozzle including steam dispensing ports for dispensing steam cleaning fluid to a surface to be cleaned, a suction port for drawing liquid and debris from the surface and a wiping member on the nozzle comprising:

a) a support base configured to detachably mount the hand-held vacuum cleaner thereon such that a nozzle of the vacuum cleaner is positioned over a surface to be cleaned;

b) a handle affixed to said support base and extending upwardly therefrom;

c) a wheel assembly affixed to said support base for moving the vacuum assembly and said handle over a surface to be cleaned, wherein the nozzle is positioned between a distal end of said support base and the surface to be cleaned such that the wiping member is engagable with the surface to be cleaned during use.

11. The handle accessory as recited in claim 10, wherein the suction port is positioned adjacent the wiping member.

12. The handle accessory as recited in claim 11, wherein the wiping member is a squeegee.

13. The handle accessory as recited in claim 12, wherein the squeegee substantially surrounds the suction port.

14. The handle accessory as recited in claim 10, wherein the wiping member is positioned at a predetermined angle to said surface to be cleaned when the handle is raised a predetermined height.

15. The handle accessory as recited in claim 14, wherein the predetermined angle is approximately 90°.

16. The handle accessory as recited in claim 10, wherein the steam dispensing ports are disposed proximal of the suction port.

* * * * *